US005980239A

United States Patent [19]

Doucet et al.

[11] Patent Number: 5,980,239

[45] Date of Patent: Nov. 9, 1999

[54] CHILD RESISTANT LIGHTER

[75] Inventors: Michel Doucet, Bains sur Oust, France; Enrique Amoros Nollas, Reus, Spain; Rene Frigiere, Allaire, France; Paul H. Adams, Monroe; Thomas G. Vailionis, Watertown, both of Conn.

[73] Assignee: BIC Corporation, Milford, Conn.

[21] Appl. No.: 09/137,308

[22] Filed: Aug. 21, 1998

Related U.S. Application Data

[63] Continuation-in-part of application No. 08/922,040, Sep. 2, 1997, Pat. No. 5,833,448.

[51] Int. Cl.[6] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| 3,169,672 | 2/1965 | Soffer et al. | 222/153 |
| 3,898,031 | 8/1975 | Rusakowicz | 431/130 |
| 4,424,920 | 1/1984 | Tada | 222/402.11 |
| 4,752,020 | 6/1988 | Grueter et al. | 222/402.15 |
| 4,784,602 | 11/1988 | Nitta | 431/153 |
| 4,859,172 | 8/1989 | Nitta | 431/153 |
| 4,904,180 | 2/1990 | Nitta | 431/153 |
| 4,962,869 | 10/1990 | Gross et al. | 222/153 |
| 5,035,608 | 7/1991 | Parren | 431/153 |
| 5,145,358 | 9/1992 | Shike et al. | 431/153 |
| 5,228,849 | 7/1993 | Frigiere | 431/255 |
| 5,445,518 | 8/1995 | McDonough et al. | 431/153 |
| 5,462,432 | 10/1995 | Kim | 431/153 |
| 5,520,197 | 5/1996 | McDonough et al. | 131/329 |
| 5,531,591 | 7/1996 | Yamazaki | 431/153 |
| 5,655,901 | 8/1997 | Makoto | 431/153 |
| 5,662,466 | 9/1997 | Cheng | 431/153 |
| 5,676,537 | 10/1997 | Fang | 431/153 |
| 5,704,776 | 1/1998 | Sher | 431/153 |

FOREIGN PATENT DOCUMENTS

| | | |
|---|---|---|
| 2 295 359 | 7/1976 | France . |
| WO 97/27431 | 7/1997 | WIPO . |

*Primary Examiner*—Carroll Dority
*Attorney, Agent, or Firm*—Pennie & Edmonds LLP

[57] ABSTRACT

A lighter of the disposable type, ignition of which requires depression of an actuator that is resistant to the manipulations of unintended users. The lighter is normally maintained in a position that prevents depression of the actuator through the incorporation of a mechanism that increases the difficulty of operation. The actuation inhibiting mechanism requires a downward displacement and a tilted displacement in order to allow full depression of the actuator and activation of an ignition mechanism. Preferably, at least one biasing element is provided so that when the actuator is displaced through the application of force by a user, it returns to the initial blocking position when the force is removed.

39 Claims, 10 Drawing Sheets

CHILD RESISTANT LIGHTER

CROSS-REFERENCE TO RELATED APPLICATION

The present application is a continuation-in-part of U.S. patent application Ser. No. 08/922,040 filed Sep. 2, 1997, now U.S. Pat. No. 5,833,448, which is incorporated herein in its entirety.

BACKGROUND OF THE INVENTION

1. Technical Field

The present invention relates to a lighter employing an ignition system which presents increased difficulty of operation by unintended users and, more particularly, relates to a piezoelectric lighter with such a system.

2. Discussion of the Related Art

Disposable gas lighters are available in a variety of forms. One common element of disposable lighters is an actuator pad or lever used to initiate the flow of fuel. An actuator pad is operated in conjunction with a spark producing mechanism so that the flow of fuel is ignited soon after it commences. For example, lighters employing conventional spark wheels require a user to rotate a toothed spark wheel against a flint in order to generate a spark. The user then depresses the actuator pad, releasing gas and producing a flame.

Another means of ignition for disposable lighters employs a piezoelectric mechanism. In this type of ignition mechanism, a piezoelectric element, such as a crystal, is struck by an anvil in order to produce an electric spark. The spark is conducted to a location near the opening of the valve to ignite the gaseous fuel. The actuator pad, upon forced depression by a user, commences both the flow of the fuel and the ignition process. An example of such a piezoelectric ignition mechanism is disclosed in U.S. Pat. No. 5,262,697, entitled "Piezoelectric Mechanism For Gas Lighters."

As with spark wheel ignition mechanisms, measures have been introduced to increase difficulty of activation such as to prevent unintended activation of piezoelectric mechanisms or activation by unintended users (e.g., children 5 years old and younger). One typical method employed is to incorporate a separate latch member disposed under the actuator pad which inhibits depression of the actuator pad. Examples of such mechanisms are shown in U.S. Pat. Nos. 5,435,719, 5,584,682, and 5,636,979.

There remains, however, a need in the art for improved mechanisms which increase the difficulty of operation unintentionally or by unintended users, and at the same time which are user-friendly for the intentional and intended user.

SUMMARY OF THE INVENTION

It is thus an object of the present invention to provide a lighter that is operable by an adult upon intended actuation movements, but which is resistant to operation by unintended users.

It is a related object of the present invention to provide a lighter that has an actuator that is preferably movable in at least two directions and preferably in more than two directions to actuate the lighter.

These and other objects of the present invention are met by providing a lighter having an elongated body defining a fuel reservoir and a valve for dispensing such fuel. An ignition system, including a spark producing mechanism such as a piezoelectric mechanism, is also provided to generate a spark at about the time fuel is selectively released from the reservoir to generate a flame. The lighter further includes an actuator that, upon movements along a predetermined path, actuates the ignition system. An actuation inhibiting mechanism is provided to define the predetermined path that the actuator is moved in order to actuate the ignition system.

The actuation inhibiting mechanism includes a blocking mechanism and an interlocking mechanism selectively positioned relative to the lighter body to define the predetermined path. The actuation inhibiting mechanism is preferably arranged so that the actuator is moved at least in an actuation direction (in the direction the spark producing mechanism is moved to generate a spark) and in a direction transverse to the actuation direction (in a generally tilted direction, predominantly in the transverse direction) to actuate the ignition mechanism. Upon removal of the applied force required to depress the actuator, the actuation inhibiting mechanism is biased to return to its initial position wherein movement of the actuator along the predetermined path is needed in order to actuate the ignition system.

BRIEF DESCRIPTION OF THE DRAWINGS

These and other objects, features, and advantages of the invention will become more readily apparent from the following detailed description of the invention, which should be read in conjunction with the accompanying drawings, in which like reference characters, represent like elements, and in which.

DETAILED DESCRIPTION OF THE INVENTION

Figure 1:
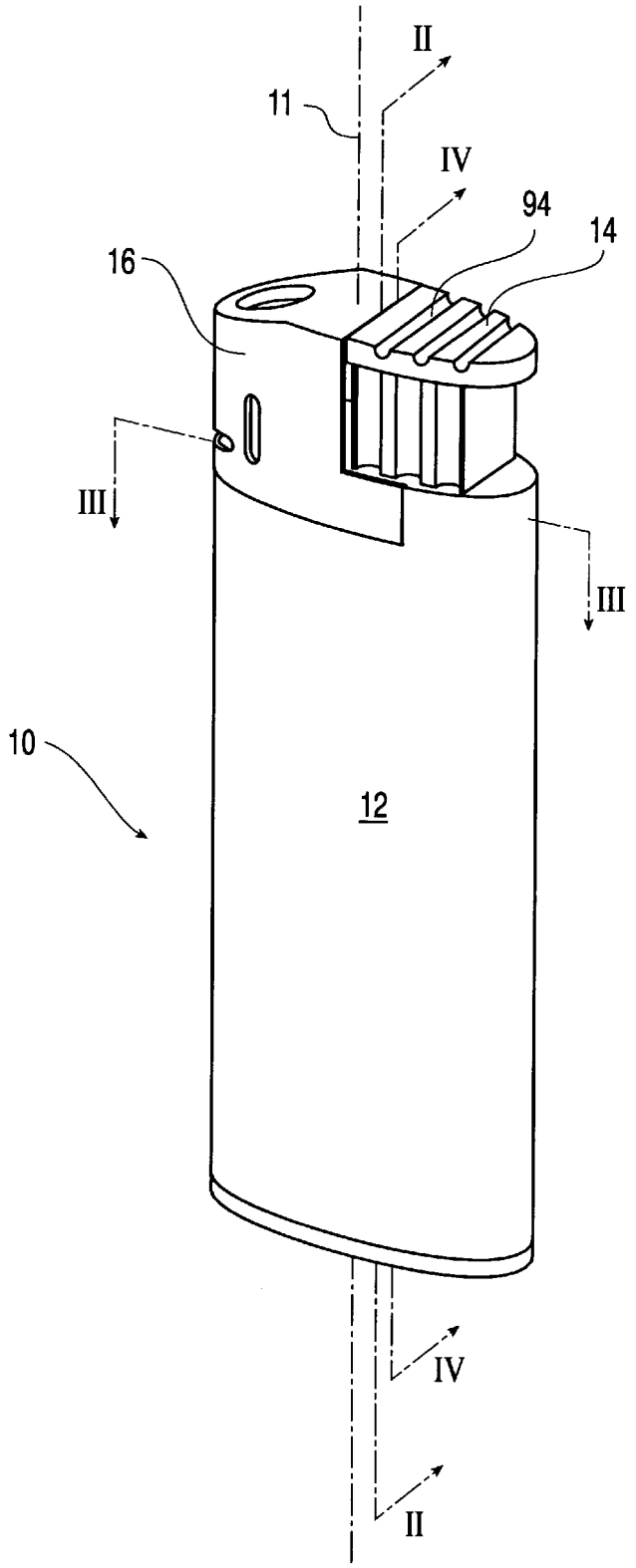
FIG. 1 is a perspective view of a lighter having a actuation inhibiting mechanism formed in accordance with the principles of the present invention.

A lighter 10 having an actuation inhibiting mechanism formed in accordance with the principles of the present invention is shown in FIG. 1. Lighter 10 has a longitudinal axis 11, a body portion 12, a depressible valve actuator 14, and a wind shield 16. Additionally, a valve 18 and an ignition mechanism 20 is provided within lighter 10, as may be seen in, for example, the cross-sectional views of FIGS. 2 and 3.

Figure 2:
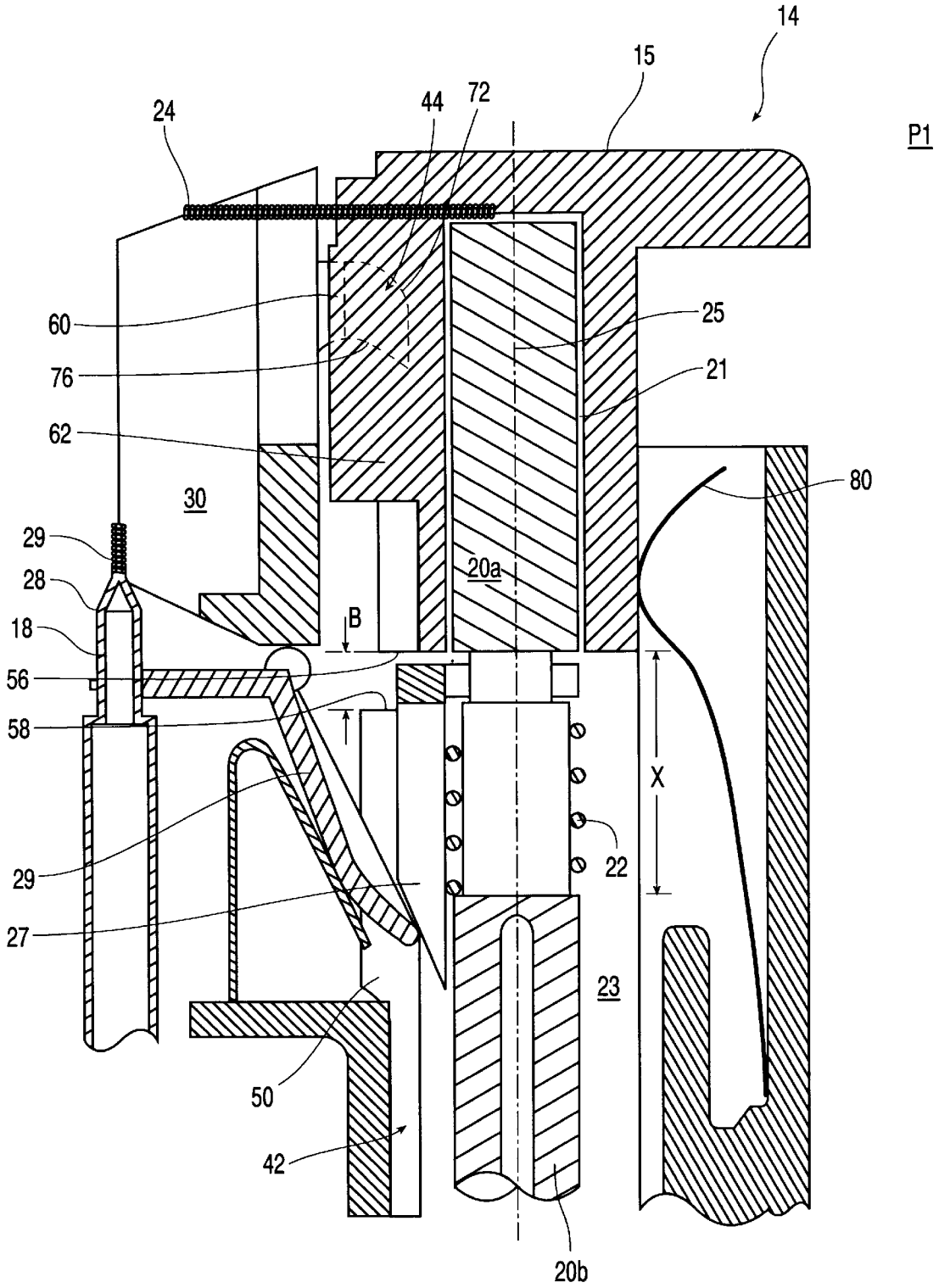
FIG. 2 is a partial cross-sectional view, along line II—II, of the lighter of FIG. 1, showing the actuator in an initial position and a substantially central cross-sectional view of the actuation inhibiting mechanism.
Figure 3:
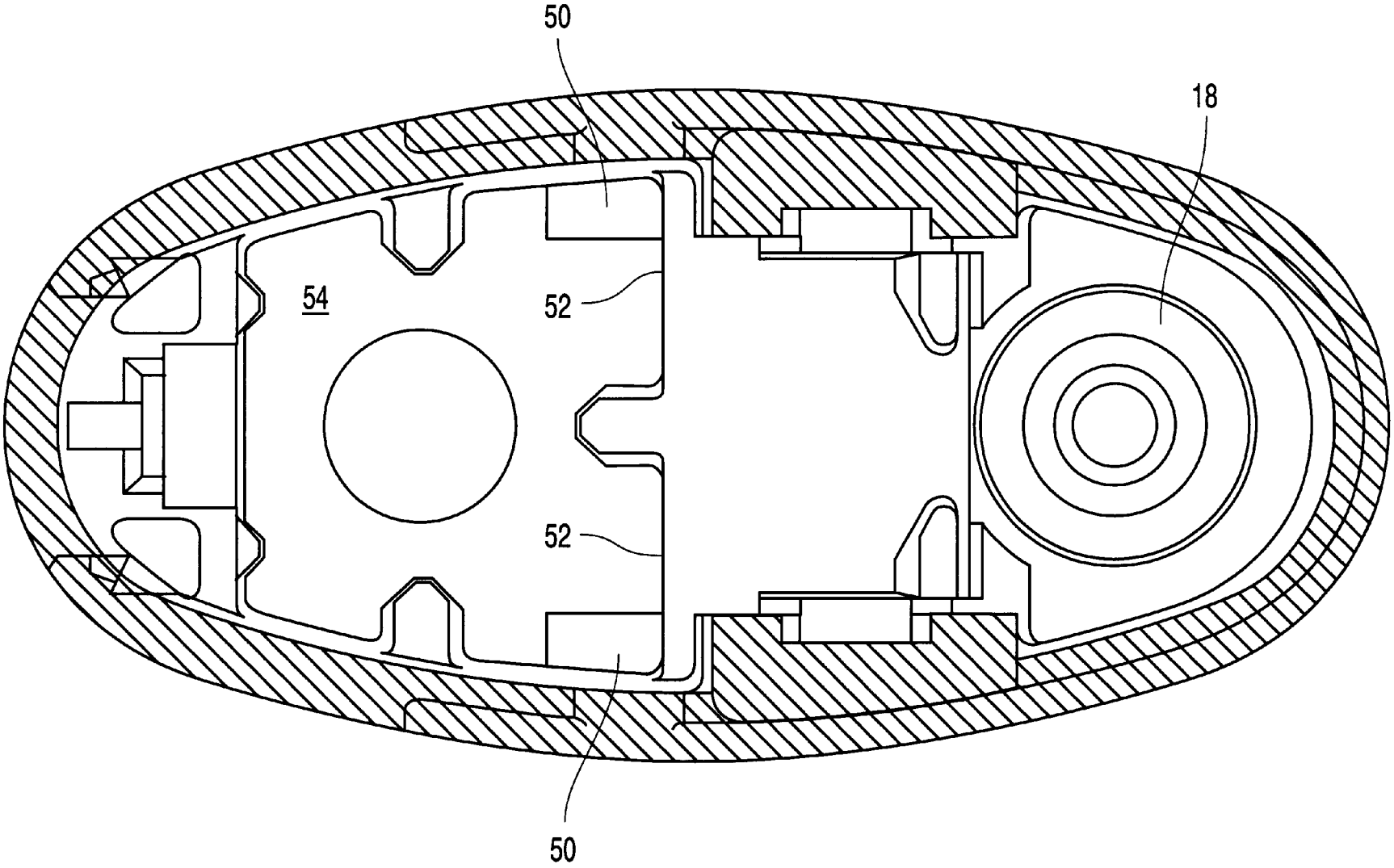
FIG. 3 is a partial cross-sectional view, along line III—III, of FIG. 1 of the lighter of the present invention.

Referring now to FIG. 2, further details of the ignition system and actuation inhibiting mechanism of lighter 10 are depicted. An upper portion 20*a* of ignition mechanism 20 is coupled to or is held in a cavity 21 within actuator 14. Although a tight fit between upper portion 20*a* and actuator 14 may be desirable, such a tight fit may slightly bend ignition mechanism 20 during use. Alternatively, to alleviate such bending, sufficient clearance may be provided between cavity 21 of actuator 14 and upper portion 20*a* of ignition mechanism 20 so that ignition mechanism 20 is not subjecting to excessive bending forces during actuation of lighter 10, as will be appreciated with reference to the operation of the lighter as described below. A spring member may be disposed in the clearance between cavity 21 and upper portion 20*a* to ensure sufficient contact and support between upper portion 20*a* and actuator 14.

A lower portion 20*b* of ignition mechanism 20 is received in a cooperating recess 23 in body 12. It will be appreciated that the terms "upper" and "lower" only describe the relative positions of portions 20*a*, 20*b* as depicted in the Figures, and do not limit these portions to such positions. Biasing element 22, such as a coil spring, is positioned between upper and lower portions 20*a*, 20*b* of ignition mechanism 20. Coil spring 22 resists the movements of portions 20*a* and 20*b* relative to each other, and thus the actuation of ignition mechanism 20. Biasing element 22 also biases against, thereby resisting the movement of, actuator 14. Thus, the upper and lower portions 20*a*, 20*b* of ignition mechanism 20 are compressibly joined and actuator 14 is maintained in an initial position in which upper and lower portions 20*a*, 20*b* are spaced apart as shown in FIG. 2.

The basic operation of disposable lighters, particularly piezoelectric lighters, is well known and therefore is only briefly described herein. When at an "initial position," the upper and lower portions 20*a*, 20*b* of ignition mechanism 20 are separated by a gap, denoted by X in FIG. 2, and top surface 15 of actuator 14 is located at a position "P1". Movement of the top surface 15 of actuator 14 from the initial position P1 to an actuation position "P2" (See FIG. 12) causes upper and lower portions 20*a*, 20*b* to move along an actuation axis 25 and thereby compresses ignition mechanism 20. In piezoelectric lighters such as the present invention, compression of ignition mechanism 20 causes an anvil, which is slideably disposed within ignition mechanism 20, to strike a piezoelectric element fixedly located within ignition mechanism 20. The operation of this piezoelectric ignition system is fully described in the '697 patent, which is incorporated herein by reference.

A spark conductor 24, electrically coupled to ignition mechanism 20 in a known manner, is mounted on actuator 14 to move therewith. A ramping member 27 is attached to the ignition mechanism 20 such that the ramping member 27 is moved along the actuation axis when the ignition mechanism is moved along actuation axis. Ramping member acts on lever 29 to rotate lever 29 (in the counter-clockwise direction as shown in the drawings) to lift valve 18. Successful movement of actuator 14 sufficient to ignite ignition mechanism 20 opens valve 18, thus selectively releasing fuel from reservoir 26 through nozzle 28, and moves spark conductor 24 closer to an electrically conductive diffuser 29 located above nozzle 28. Actuation of the piezoelectric element (or other form of ignition mechanism usable in the lighter of the present invention), upon successful movement of actuator 14, produces an electrical impulse across spark conductor 24 and diffuser 29 through ignition cavity 30. An electrical arc is generated across the gap from spark conductor 24 to the electrically conductive diffuser 29, thus igniting the fuel selectively released through valve 18.

An actuation inhibiting mechanism is provided to inhibit depression of actuator 14 and to increase the difficulty of actuating the ignition mechanism 20 and lighting of lighter 10. The actuation inhibiting mechanism includes a blocking mechanism 42 and an interlocking mechanism 44 which direct movements along actuation axis 25 and movements transverse to actuation axis 25, respectively.

Blocking mechanism 42 includes a blocking element 50 attached to or located on or near inner wall 52 of lighter body 12. As may be seen in FIG. 3, preferably two blocking elements 50 are provided within lighter body 12, one on each side of cavity 54 in lighter body 12. When top surface 15 of actuator 14 is at initial elevation P1, before depression of actuator 14, a lower surface 56 of actuator 14 is aligned with and spaced from blocking surface 58 of blocking element 50. Actuator 14 thus may only be depressed a distance B (FIG. 2) along actuation axis 25 before the lower surface 56 of actuator 14 engages blocking surface 58 of blocking element 50. Thus, further depression along actuation axis 25 is arrested. Accordingly, upper and lower portions 20*a*, 20*b* of ignition mechanism 20 remain separated by distance X', as may be seen in FIG. 10 (described in further detail below). Preferably, ignition mechanism 20 is configured and dimensioned such that compression of the ignition mechanism to the distance X' is insufficient to cause the anvil to strike the piezoelectric element, to produce a flame. Likewise, top surface 15 of actuator 14 can only be moved from the initial position P1, to an intermediate position "IP" without being able to reach actuation position P2. It will be appreciated that other arrangements including a blocking element fixed to lighter body 12 and arranged to engage actuator 14 or an element coupled thereto to inhibit movement of actuator 14 are within the scope of the present invention.

In order for actuator 14 to clear or misalign with blocking element 50, i.e., in order to move lower surface 56 of actuator 14 out of alignment with blocking surface 58 of blocking element 50 from the intermediate position IP, actuator 14 is moved in a transverse direction to actuation axis 25 and away from blocking element 50. However, interlocking mechanism 44 of the actuation inhibiting mechanism inhibits such transverse movement of actuator 14 from its initial position. Thus, until interlocking mechanism 44 is disengaged, actuator 14 cannot be moved to a position out of alignment with blocking mechanism 42.

Interlocking mechanism 44 includes a stationary interlocking portion 60 fixedly mounted to lighter body 12 and a movable interlocking portion 62, mounted to actuator 14. Reference is made to the cross-sectional views of FIGS. 2 and 4 for an illustration of the interrelationship between stationary interlocking portion 60 and movable interlocking portion 62. Movable interlocking portion 62 preferably extends from an interior wall of actuator 14 to cooperate with stationary interlocking portion 60. Movable interlocking portion 62 thus moves along with actuator 14 with respect to lighter body 12 and stationary interlocking portion 60. Preferably, actuator 14 is formed integral with movable interlocking portion 62.

Further reference is made to FIGS. 5–9 for an illustration of the features of portions 60 and 62 of interlocking mechanism 44. As may be appreciated from FIGS. 5–7, movable interlocking portion 62 preferably includes a base projection 66 from which at least one wing 68 extends. Preferably, wings 68*a*, 68*b* extend from each side of base projection 66 such that movable interlocking portion 62 has the form of a T-shaped flange. Spark conductor 24 is preferably mounted on a mounting portion 70 of base extension 66 that extends above wings 68*a*, 68*b*.

Figure 4:
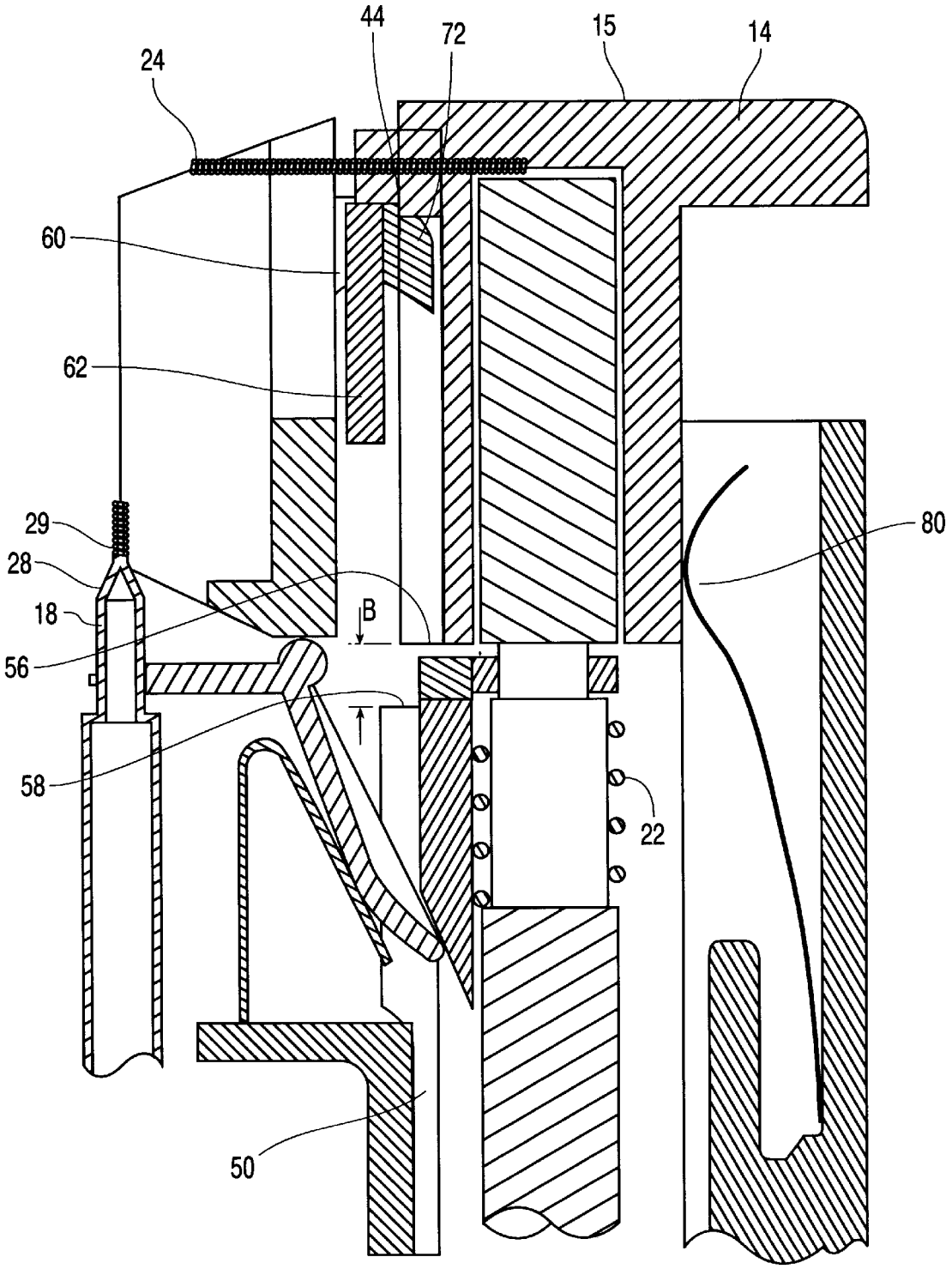
FIG. 4 is a cross-sectional view, along line IV—IV, of the lighter of FIG. 1, showing the actuator in the initial position and illustrating another cross-sectional plane of the actuation inhibiting mechanism.
Figure 8:
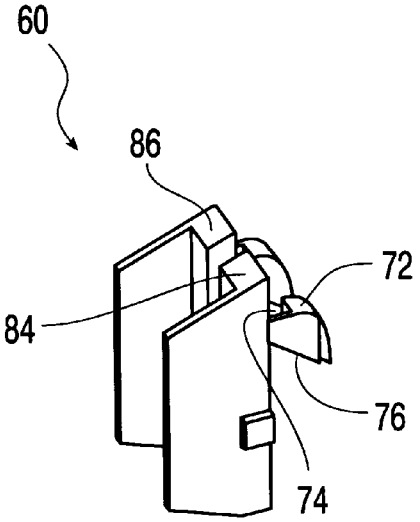
FIG. 8 is a perspective view of the stationary portion of the interlocking mechanism of the actuation inhibiting mechanism of the present invention.
Figure 9:
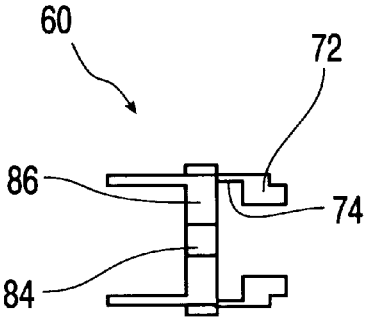
FIG. 9 is a top plan view of the stationary portion of the interlocking mechanism of FIG. 8.

As may be appreciated with reference to FIGS. 8 and 9, stationary interlocking portion 60 includes projections 72 extending towards movable interlocking portion 62 and having slots 74 formed therein to receive wings 68 of movable interlocking portion 62. It will be appreciated that the number of projections 72 on stationary portion 60 preferably corresponds to the number of wings provided on movable portion 62. When actuator 14 is in the initial position P1, as shown in FIG. 4, wings 68 are movably received within slots 74. This interlocked configuration of movable interlocking portion 62 to stationary interlocking portion 60 at the initial position P1 inhibits movement of actuator 14, in the transverse direction. Accordingly, lower surface 56 of actuator 14 cannot be moved out of alignment with blocking surface 58 of blocking element 50 at the initial position P1.

In order to move actuator 14 to actuation position P2, movable interlocking portion 62 and actuator 14 are disengaged from stationary interlocking portion 60. Such disengagement of interlocking mechanism 44 includes a movement of actuator 14 transverse to actuation axis 25 to permit further movement of actuator 14 along actuation axis 25 (substantially parallel to the movement of actuator 14 between initial position P1 and intermediate position IP) to reach actuation position P2. Accordingly, projections 72 have angled undercuts 76 which preferably guide the removal of wings 68 from slots 74 by movement of movable interlocking portion 62 away from stationary interlocking portion 60 as follows. Upon movement of actuator 14 along actuation axis 25, wings 68 slide through slots 74 towards undercuts 76 until tops 78 of wings 68 reach undercuts 76, whereupon wings 68 may be slid out and removed from slots 74. It will be appreciated that tops 78 of wings 68 reach undercuts 76 as lower surface 56 of actuator 14 approaches blocking surface 58 of blocking element 50—before or substantially at the same time that actuator 14 reaches intermediate position IP. Hence intermediate position IP may also be any position where transverse movement of actuator 14 is allowed.

Figure 11:
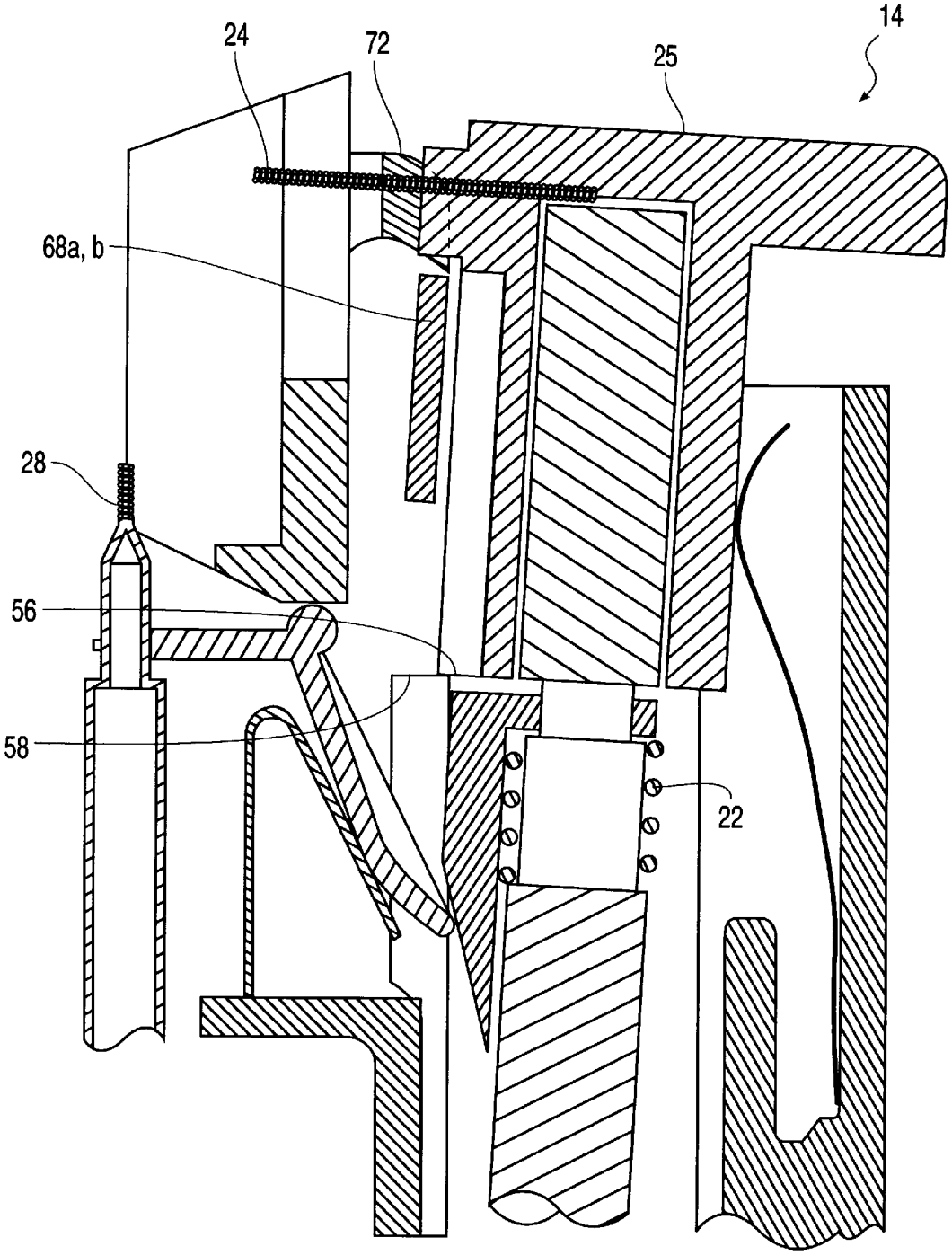
FIG. 11 is a cross-sectional view similar to that of FIG. 10, but with the actuator disengaging from the blocking mechanism of the actuation inhibiting mechanism.

Removal of wings 68 from slots 74, and consequent disengagement of interlocking portions 60 and 62, generally includes a movement of actuator 14 transverse to actuation axis 25 most typically achieved by a tilting movement, as shown in FIG. 11 and described in greater detail below. If desired, a biasing element 80, as shown in FIG. 2, such as a leaf spring, may be positioned to resist motion of actuator 14 in the transverse direction. Preferably, undercuts 76 are angled to facilitate removal of wings 68*a,b* from slots 74 by such tilting movement of actuator 14, as well as to facilitate re-entry of wings 68*a,b* into slots 74 after actuation of ignition mechanism 20. Such re-entry is further facilitated by biasing element 80. Preferably, tops 78 of wings 68*a,b* maintain contact with undercuts 76 during the removal of wings 68*a,b* from slots 74.

Several features are provided to enhance engagement of interlocking portions 60 and 62, when such engagement is desired, and thus improve the appearance and function of actuator 14 with respect to lighter 10. In order to position interlocking portions 60 and 62 as close as possible to each other, grooves 82 are preferably provided along interior wall 64 of actuator 14 (in the region of movable interlocking portion 62) to receive projections 72 of stationary interlocking portion 60, as may be appreciated with reference to FIGS. 4, 6, 7, and 9 so that actuator 14 may return to initial position P1 as described in greater detail below. Additionally, an ignition cutout 84 is formed in the wall 86 connecting projections 72 of stationary interlocking portion 60. Ignition cutout 84 is aligned with base projection 66 of movable interlocking portion 62, and thus with mounting portion 70 on which spark conductor 24 is mounted. Thus, upon depression of actuator 14, spark conductor 24 is depressed and passes through ignition cutout 84 to approach conductive nozzle 28 to permit generation of an electrical arc.

Figure 5:
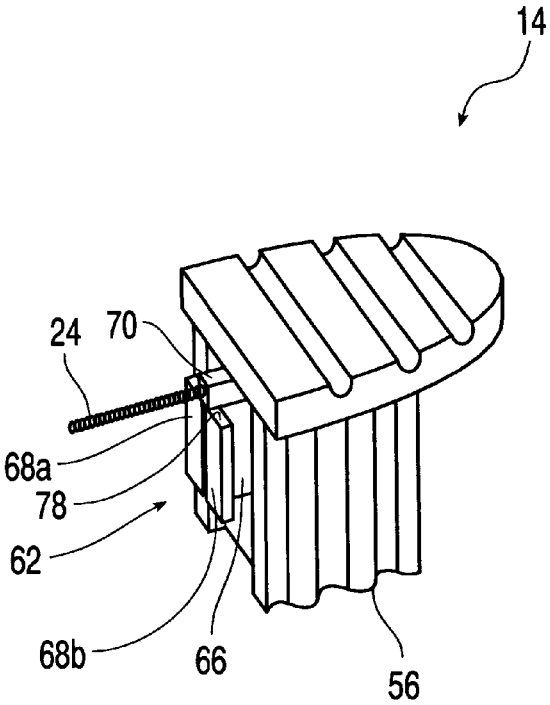
FIG. 5 is a perspective view of the actuator of the present invention, showing a movable portion of an interlocking mechanism of the actuation inhibiting mechanism of the present invention.
Figure 6:
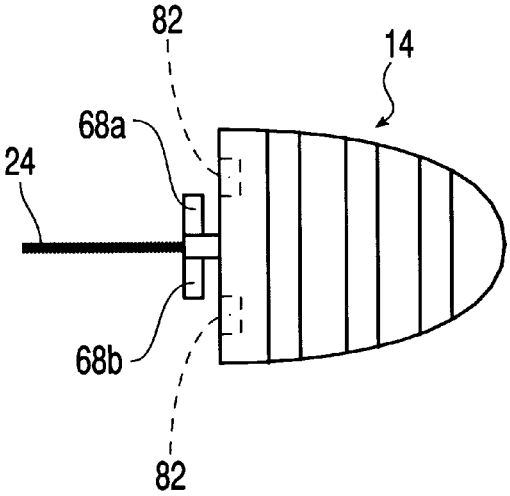
FIG. 6 is a top plan view of the actuator of FIG. 5.
Figure 7:
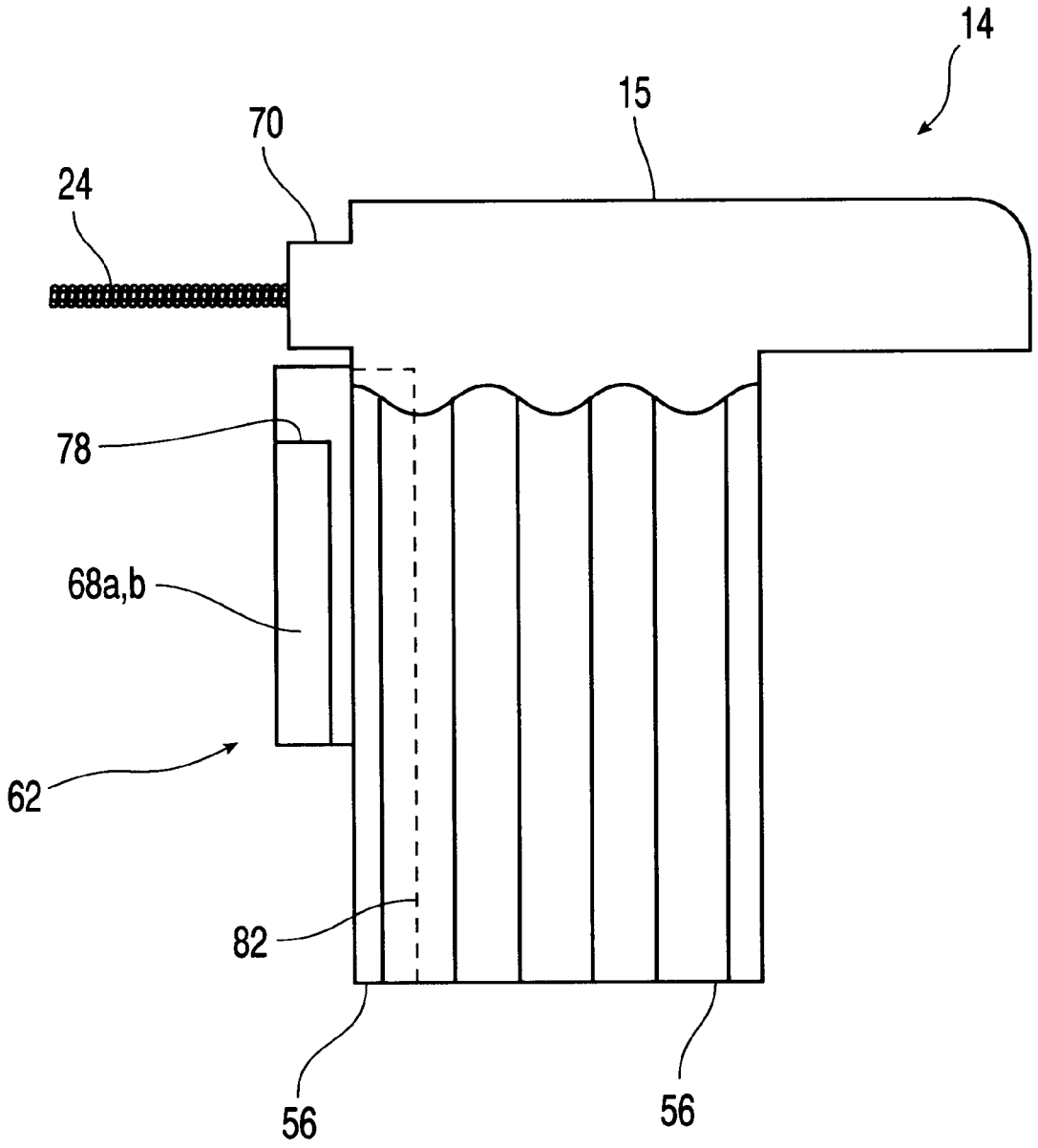
FIG. 7 is a side elevational view of the actuator of FIG. 5.
Figure 10:
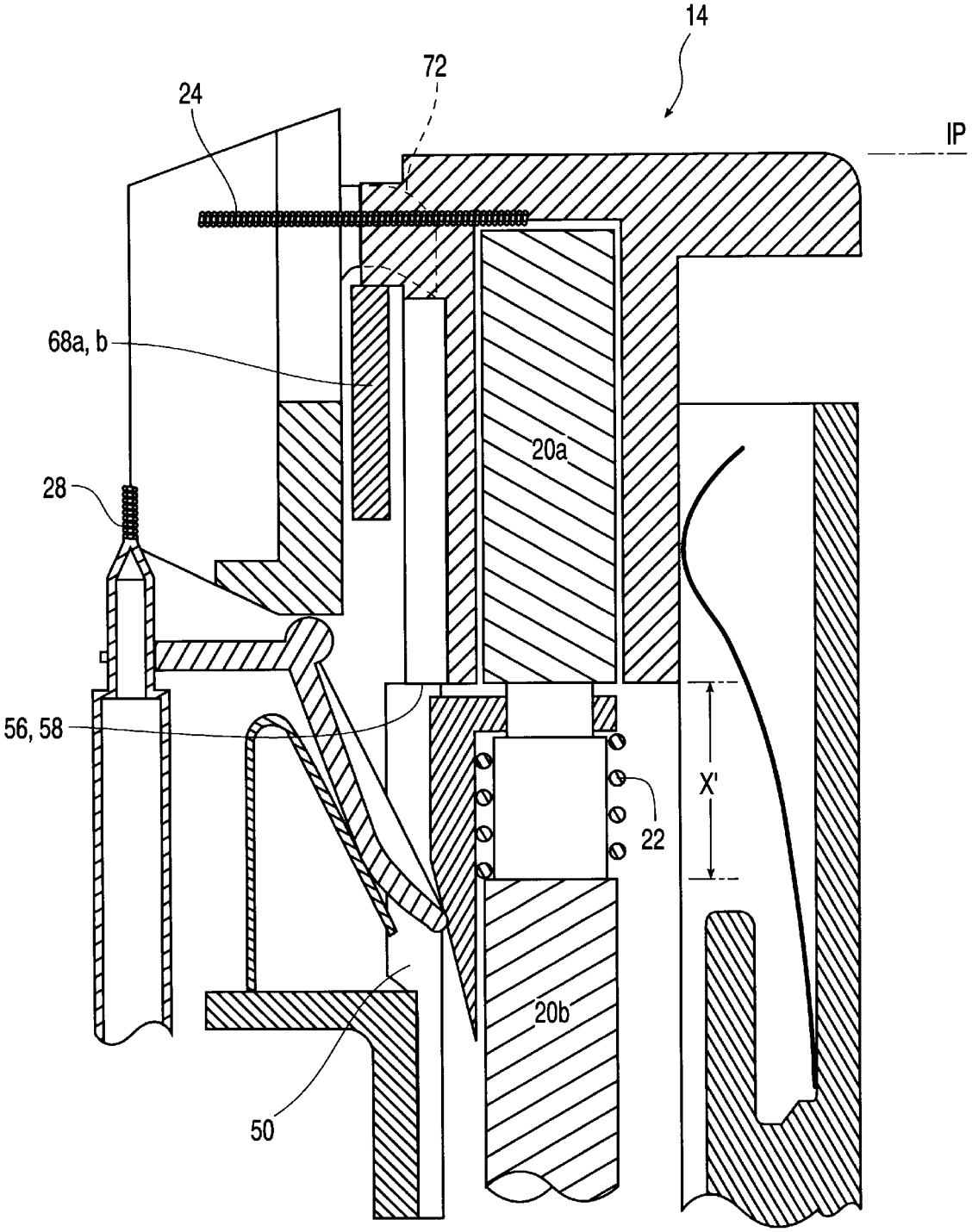
FIG. 10 is a cross-sectional view, along line IV—IV of FIG. 1 and similar to that of FIG. 4, of the lighter of FIG. 1 showing the actuator in an intermediate position.

The series of steps required to generate a flame, described briefly above, are illustrated with respect to FIGS. 2 and 10–12. In order for intended users to operate lighter 10, actuator 14 is first depressed from initial position P1 to intermediate position IP, as shown in FIG. 10. To aid the user in moving actuator 14, top surface 15 may be shaped and configured to provide increased friction with the user's finger to facilitate movement thereof by the user. Illustratively, this may be accomplished by forming on top surface 15 one or more ridges 94, as shown in FIGS. 1, 5 and 6.

As described above, blocking element 50 prevents actuator 14 from being depressed below intermediate position IP to reach actuation position P2. Moreover, interlocking mechanism 44 prevents transversal movement of actuator 14 out of blocking alignment with blocking element 50 in the initial position P1. It will be appreciated that once actuator 14 substantially reaches intermediate position IP, tops 78 of wings 68 are adjacent undercuts 76. Thus, the user may begin to move actuator 14 transverse to actuation axis 25 to disengage interlocking mechanism 44 and to bring actuator 14 out of alignment with blocking element 50, as shown in FIG. 11. If desired, actuator 14 may be pivoted against blocking element 50 and tilted (a motion including a component transverse to actuation axis 25) to achieve the desired motion necessary to release wings 68 from slots 74 and thus to disengage movable interlocking portion 62 from stationary interlocking portion 60.

Figure 12:
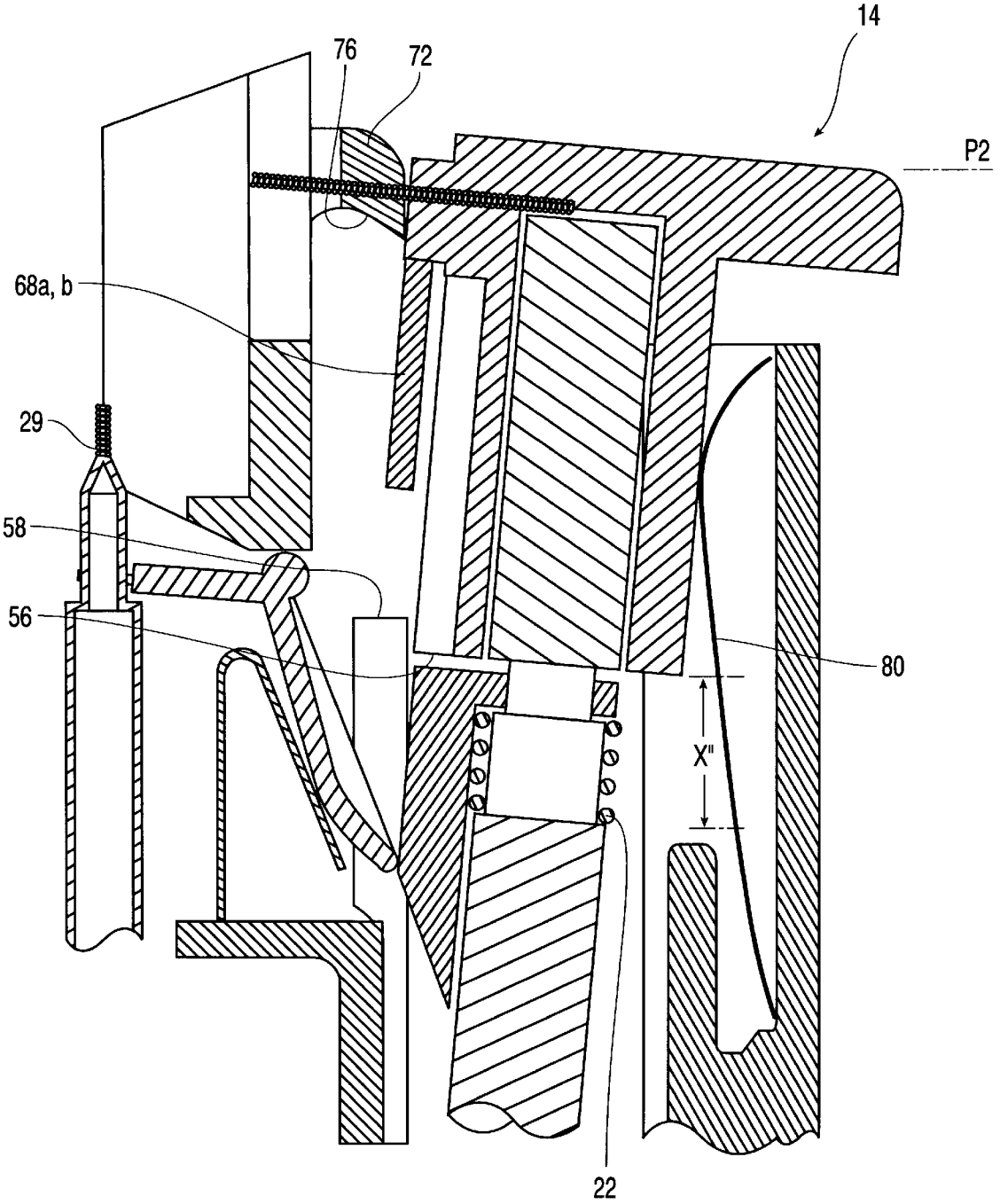
FIG. 12 is a cross-sectional view similar to that of FIG. 10, but with the actuator in the ignition actuation position.

The motion of actuator 14 from the intermediate position IP in the transverse direction, as illustrated in FIG. 11, moves movable portion 62 out of alignment with stationary portion 60, and also moves bottom surface 56 of actuator 14 out of alignment with top surface 58 of blocking element 50. Thus, blocking mechanism 42 is disengaged and actuator 14 may be further moved within cavity 54 of lighter body 12 along actuation axis 25 to further compress upper and lower portions 20*a* and 20*b* of ignition mechanism 20, and to actuate ignition mechanism 20, as shown in FIG. 12. Upon actuation of ignition mechanism 20, the gap between upper and lower portions 20*a*, 20*b* of ignition mechanism 20, denoted by X" in FIG. 12, is at a minimum. Moreover, top surface 15 of actuator 14 reaches actuation elevation level P2.

Biasing elements 22 and 80 (if provided) bias actuator 14 to return to initial position P1 when the force applied by the user is removed. As discussed above, the shape of undercuts 76 of projection 72 as well as grooves 82 in wall 64 of actuator 14 facilitate such return of actuator 14 to the initial position P1.

Figure 13:
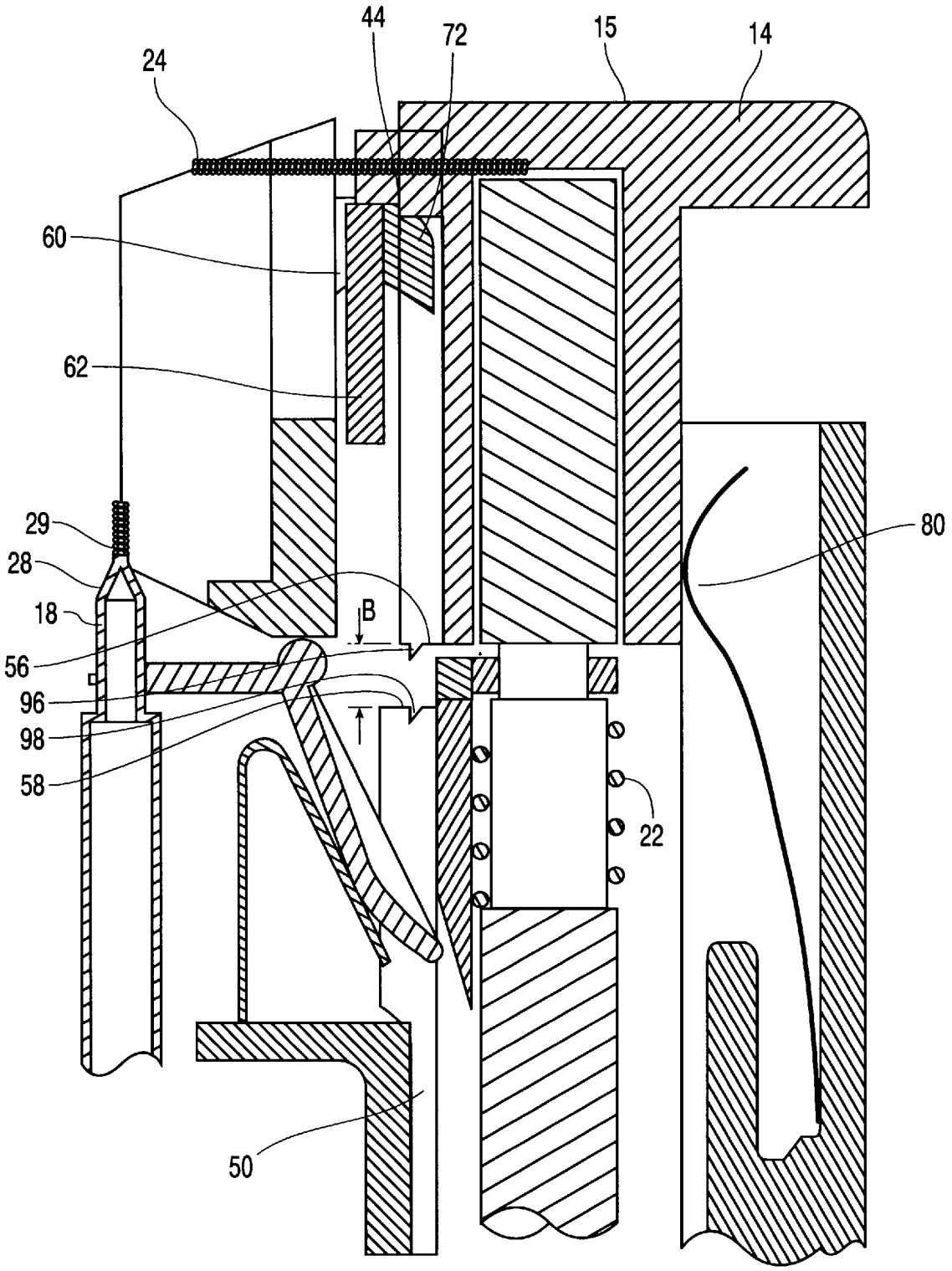
FIG. 13 is a cross-sectional view of another embodiment of the blocking mechanism.

FIG. 13 depicts a further feature which may be incorporated into blocking mechanism 42. Lower surface 62 may have an extension 96 dependent therefrom, and top surface 58 of blocking element 50 may have a recess 98 defined thereon. Extension 96 and recess 98 are configured and dimensioned such that actuator 14 reaches the intermediate position IP before extension 96 is received within recess 98 and where transverse movement of actuator 14 is allowed. Extension 96 and recess 98 can resist actuation of the lighter by resisting transverse movement of the actuator, when the user-applied displacement is greater than necessary to disengage the stationary portion 60 from the movable portion 62 of the interlocking mechanism.

The actuation inhibiting mechanism, as described above, may also increase the difficulty of selectively releasing fuel gas through valve 18. For example, ramping member 27 and lever 29 may be configured and dimensioned such that when the actuator 14 is at position IP, ramping member 27 does not act on lever 29 to selectively release gas.

The above description is intended to be illustrative, not limitative. Thus, it will be apparent to those skilled in the art that modifications may be made to the invention as described without departing from the scope of the claims set out below. For example, biasing element 22 is illustrated as a coil spring, but any other suitable biasing element may be employed instead or additionally, such as a leaf spring or an integrally molded plastic spring. Likewise, although biasing element 80 is illustrated as a leaf spring, any other suitable biasing element may be employed instead, or additionally, such as a coil spring or an integrally molded plastic spring.

The ignition mechanism and actuation inhibiting mechanism described herein are not limited to use in a lighter. These mechanisms can also be incorporated in other devices that require an enhanced child resistant mechanism, such as piezoelectric ignitions for gas grills, etc.

What is claimed is:

1. A lighter resistant to use by unintended users, said lighter comprising:

a lighter body having a fuel compartment;

a valve for supplying fuel from said fuel compartment;

an actuator mounted for movement with respect to said lighter body;

an ignition mechanism having an actuation axis, movement of said actuator from a first position along said actuation axis to an actuation position along said longitudinal axis causing said ignition mechanism to ignite said fuel; and an actuation inhibiting mechanism arranged to limit movement of said actuator along and transverse to said actuation axis when said actuation inhibiting mechanism is engaged, whereupon disengagement of said actuation inhibiting mechanism permits movement of said actuator from said first position to said actuation position to actuate said ignition mechanism to ignite said fuel.

2. A lighter as in claim 1, wherein:

said actuation inhibiting mechanism permits partial movement of said actuator along said actuation axis between said first position and an intermediate position, said intermediate position is between said first position and said actuation position;

when engaged, said actuation inhibiting mechanism resists movement of said actuator from said intermediate position to said actuation position; and said actuation inhibiting mechanism resists movement of said actuator transverse to said actuation axis as said actuator is moved from said first position towards said intermediate position.

3. A lighter as in claim 2, wherein said actuation inhibiting mechanism permits movement of said actuator transverse to said actuation axis when said actuator is at said intermediate position such that said actuator may be moved transverse to and then along said actuation axis toward said actuation position.

4. A lighter as in claim 1, wherein said actuation inhibiting mechanism comprises an interlocking mechanism arranged to resist movement of said actuator transverse to said actuation axis when said actuator is at said first position.

5. A lighter as in claim 4, wherein said interlocking mechanism comprises:

a first projection moveable with said actuator; and a second projection fixed with respect to said lighter body;

wherein said first and second projections are movable with respect to each other between an engaged configuration where said interlocking mechanism prevents movement of said actuator transverse to said actuation axis and a disengaged configuration where said first projection is movable away from said second projection and said actuator is movable transverse to said actuation axis.

6. A lighter as in claim 5, wherein:

said first projection comprises a base projection and at least one wing extending therefrom; and said second projection includes a slot for receiving said at least one wing, and an undercut permitting removal of said at least one wing from said slot as said actuator approaches said intermediate position.

7. A lighter as in claim 6, further comprising a blocking mechanism arranged to permit movement of said actuator from said first position to said intermediate position and to resist further movement of said actuator toward said actuation position when said blocking mechanism is engaged.

8. A lighter as in claim 7, wherein movement of said actuator from said first position toward said intermediate position permits disengagement of said interlocking mechanism such that said actuator may be moved away from said blocking mechanism and thereafter further moveable towards said actuation position to actuate said ignition mechanism.

9. A lighter as in claim 8, wherein said actuator is tiltable relative to said lighter body when in said intermediate position to disengage said interlocking mechanism and said blocking mechanism and thus to permit further movement of said actuator to said actuation position.

10. A lighter as in claim 1, further comprising a blocking mechanism arranged to permit movement of said actuator from said first position to an intermediate position between said first position and said actuation position, and to inhibit further movement of said actuator toward said actuation position when said blocking mechanism is engaged.

11. A lighter as in claim 10, wherein said actuator is tiltable when in said intermediate position to disengage said blocking mechanism and to permit further movement of said actuator toward said actuation position.

12. A lighter as in claim 10, further comprising a biasing element biasing said actuator toward a position where said blocking mechanism is engaged.

13. A lighter as in claim 1, wherein:

said actuation inhibiting mechanism permits partial movement of said actuator from a first position to an intermediate position located between said first position and said actuation position; and said actuator is tiltable with respect to said actuation axis when said actuator is in said intermediate position to permit movement of said actuator from said intermediate position to said actuation position.

14. A lighter as in claim 13, wherein:

said actuation inhibiting mechanism resists movement of said actuator transverse to said actuation axis between said first position and said intermediate position; and said actuation inhibiting mechanism permits partial movement of said actuator along said actuation axis between said first position and said intermediate position.

15. A lighter as in claim 14, wherein said further movement of said actuator from said intermediate position toward said actuation position is along said actuation axis.

16. A lighter as in claim 13, wherein said ignition mechanism is partially bent upon movement of said actuator from said first position to said actuation position.

17. A lighter as in claim 16, wherein:

said actuation inhibiting mechanism permits partial movement of said actuator along said actuation axis between said first position and said intermediate position;

said actuation inhibiting mechanism permits movement of said actuator at said intermediate position to cause bending of said ignition mechanism and disengagement of said actuation inhibiting mechanism upon tilting of said actuator; and disengagement of said actuation inhibiting mechanism permits further movement of said actuator from said intermediate position to said actuation position.

18. A lighter as in claim 17, wherein movement of said actuator from said intermediate position to said actuation position is along said actuation axis.

19. A lighter as in claim 16, wherein:

said ignition mechanism comprises a first portion mounted in a cavity defined in said actuator and a second portion mounted in said lighter body; and said first portion is tightly fit within said cavity in said actuator such that tilting of said actuator causes bending of said ignition mechanism.

20. A lighter as in claim 13, wherein:

said ignition mechanism comprises a first portion mounted in a cavity defined in said actuator and a second portion mounted in said lighter body; and said first portion fits within said cavity in said actuator with sufficient clearance such that tilting of said actuator does not impart bending forces to said ignition mechanism.

21. A lighter as in claim 20, wherein a biasing member is disposed in the clearance between the first portion of the ignition mechanism and walls of said cavity.

22. A lighter as in claim 8 wherein the blocking mechanism comprises an extension member cooperatively engaging with a recess to resist movement between the intermediate position and the actuating position when a user-applied displacement is greater than necessary to disengage the first projection from the second projection of the interlocking mechanism.

23. A method of preventing unintended use of a lighter comprising the steps of:

providing a lighter having a lighter body, a fuel compartment, a nozzle coupled to said fuel reservoir, an ignition mechanism having an actuation axis, an actuator movable along said actuation axis from a first position to an actuation position in which said actuator causes said ignition mechanism to create a flame, and an actuation inhibiting mechanism;

arranging said actuation inhibiting mechanism to inhibit movement of said actuator transverse to said actuation axis when at said first position;

arranging said actuation inhibiting mechanism to inhibit movement of said actuator from said first position to said actuation position by inhibiting movement of said actuator along said actuation axis beyond an intermediate position between said first position and said actuation position and by inhibiting movement of said actuator transverse to said actuation axis; and arranging said actuation inhibiting mechanism to permit movement of said actuator from said intermediate position to said actuation position to actuate said ignition mechanism after said actuator is moved transverse to said actuation axis.

24. A method as in claim 23, further comprising the step of arranging said actuation inhibiting mechanism to permit movement of said actuator transverse to said actuation axis only after movement of said actuator from said first position toward said intermediate position.

25. A method as in claim 24, further comprising the step of mounting said actuator in said housing to be tiltable when in said intermediate position to move said actuator transverse to said actuation axis and to permit further movement of said actuator from said intermediate position to said actuation position.

26. A child resistancy apparatus for devices including a body portion and an actuator movably mounted on said body portion, said child resistancy apparatus comprising:

a first mechanism cooperating with said actuator to limit movement of said actuator to a first direction between a first position and an intermediate position; and a second mechanism cooperating with said actuator to prevent movement of said actuator in a second direction transverse to said first direction as said actuator is moved between said first position and said intermediate position;

wherein movement of said actuator in said first direction and in said second direction permits said actuator to be further moved in a third direction substantially parallel to said first direction.

27. The child resistancy apparatus according to claim 26, wherein said body portion comprises the body of a child resistant lighter and said actuator comprises the valve actuator of said lighter.

28. The child resistancy apparatus according to claim 27, wherein said lighter includes a piezoelectric ignition mechanism.

29. The child resistancy mechanism according to claim 28, wherein said second mechanism comprises a flange part mounted on said actuator and a slot defining member having a slot and secured to said body portion, wherein said flange part is slideably received in and retained by said slot of said slot defining member such that depression of said actuator to at least said intermediate position causes said flange part to disengage from said slot.

30. The child resistancy mechanism according to claim 29, wherein said flange part defines a T-shaped flange and said slot defining member defines two opposed projections which slideably engage each side of said flange.

31. A lighter comprising:

an elongated housing having a fuel compartment;

a nozzle for supplying fuel from said fuel compartment;

a spark producing mechanism for igniting said fuel;

an actuator operatively engaged with said spark producing mechanism, such that movement of said actuator from a first elevation to a second elevation along an actuation axis actuates said spark producing mechanism;

a blocking member disposed on the lighter body to prevent movement of said actuator from said first elevation to said second elevation along the actuation axis until said actuator is displaced in a direction transverse to the actuation axis.

32. The lighter of claim 31 in which said the actuator is biased toward a blocking position where the blocking member prevents movement along the actuation axis.

33. The lighter of claim 31, wherein said blocking member cooperates with a surface on the actuator to prevent movement along actuation axis.

34. The lighter of claim 31, wherein said actuator is tiltable relative to the elongated housing.

35. The lighter of claim 31, wherein said actuator is first moved in a direction transverse to the actuation axis and then along the actuation axis to ignite the fuel.

36. The lighter of claim 32, wherein said actuator automatically returns to said first elevation from said second elevation when a user applied force is removed.

37. A lighter comprising:

an elongated housing having a fuel compartment;

a nozzle for supplying fuel from said fuel compartment;

a spark producing mechanism for igniting said fuel;

an actuator operatively engaged with said spark producing mechanism, such that movement of said actuator from a first elevation to a second elevation along an actuation axis actuates said spark producing mechanism; and a blocking surface on the actuator adapted to prevent movement of said actuator from said first elevation to said second elevation along the actuation axis until said actuator is displaced in a direction transverse to the actuation axis.

38. The lighter of claim 37, in which said the actuator is biased toward a blocking position where the blocking member prevents movement along the actuation axis.

39. The lighter of claim 31, wherein said blocking surface cooperates with a blocking member disposed on the elongated body to prevent movement along actuation axis.

* * * * *